US009431700B2

(12) United States Patent
Desclos et al.

(10) Patent No.: US 9,431,700 B2
(45) Date of Patent: Aug. 30, 2016

(54) MODAL ANTENNA-INTEGRATED BATTERY ASSEMBLY

(71) Applicants: Laurent Desclos, San Diego, CA (US); Sebastian Rowson, San Diego, CA (US); Jeffrey Shamblin, San Marcos, CA (US)

(72) Inventors: Laurent Desclos, San Diego, CA (US); Sebastian Rowson, San Diego, CA (US); Jeffrey Shamblin, San Marcos, CA (US)

(73) Assignee: ETHERTRONICS, INC., San Diego, CA (US)

( * ) Notice: Subject to any disclaimer, the term of this patent is extended or adjusted under 35 U.S.C. 154(b) by 315 days.

(21) Appl. No.: 13/965,035

(22) Filed: Aug. 12, 2013

(65) Prior Publication Data

US 2014/0091974 A1 Apr. 3, 2014

Related U.S. Application Data

(63) Continuation-in-part of application No. 12/886,392, filed on Sep. 20, 2010, now abandoned, and a continuation-in-part of application No. 13/726,477, filed on Dec. 24, 2012, now Pat. No. 8,648,755, which is a continuation of application No. 13/029,564, filed on Feb. 17, 2011, now Pat. No. 8,362,962, which is a continuation of application No. 12/043,090, filed on Mar. 5, 2008, now Pat. No. 7,911,402.

(60) Provisional application No. 61/243,929, filed on Sep. 18, 2009.

(51) Int. Cl.

| | |
|---|---|
| ***H01Q 3/00*** | (2006.01) |
| ***H01Q 9/00*** | (2006.01) |
| ***H01P 11/00*** | (2006.01) |
| ***H01Q 1/24*** | (2006.01) |
| ***H01Q 1/44*** | (2006.01) |
| ***H01Q 9/42*** | (2006.01) |
| ***H01Q 5/378*** | (2015.01) |

(52) U.S. Cl.
CPC ..... *H01Q 3/00* (2013.01); *H01P 11/001* (2013.01); *H01Q 1/243* (2013.01); *H01Q 1/44* (2013.01); *H01Q 5/378* (2015.01); *H01Q 9/42* (2013.01); *Y10T 29/49018* (2015.01)

(58) Field of Classification Search
CPC ..... H01Q 25/04; H01Q 3/00; H01Q 9/00
USPC ..... 343/745, 702, 850, 876, 833, 834
See application file for complete search history.

(56) References Cited

U.S. PATENT DOCUMENTS

| | | | | |
|---|---|---|---|---|
| 7,003,519 | B1 * | 2/2006 | Biettron | G06F 17/30713 707/711 |
| 7,180,464 | B2 * | 2/2007 | Chiang | H01Q 1/242 343/702 |
| 7,408,512 | B1 * | 8/2008 | Rodenbeck | H01Q 1/2208 343/700 MS |
| 7,834,813 | B2 * | 11/2010 | Caimi | H01Q 9/045 343/745 |

(Continued)

*Primary Examiner* — Huedung Mancuso
(74) *Attorney, Agent, or Firm* — Coastal Patent Law Group, P.C.

(57) ABSTRACT

A modal antenna is formed within a battery assembly for use with a portable electronic device. In certain embodiments, the antenna is printed on an exterior surface of a battery enclosure using a conductive ink. In other embodiments, the antenna is attached, or etched, on a substrate; the substrate may at least partially include a battery housing. The antenna can include an Isolated Magnetic Dipole (IMD) antenna, or other radiating structure. Active components, such as active tuning components, are optionally included in the antenna-integrated battery assembly for the purpose of tuning the antenna.

14 Claims, 7 Drawing Sheets

(56) References Cited

U.S. PATENT DOCUMENTS 8,208,980 B2 * 6/2012 Wong ..... H01Q 1/243 343/702
8,928,540 B2 * 1/2015 Desclos ..... H01Q 25/04 343/702
2005/0264455 A1 * 12/2005 Talvitie ..... H01Q 9/0442 343/702
2006/0017635 A1 * 1/2006 Zheng ..... H01Q 7/00 343/748
2010/0216520 A1 * 8/2010 Lee ..... H01Q 1/44 455/572

* cited by examiner

MODAL ANTENNA-INTEGRATED BATTERY ASSEMBLY

CROSS-REFERENCE TO RELATED APPLICATIONS

This application is a continuation in part (CIP) of U.S. Ser. No. 12/886,392, filed Sep. 20, 2010, titled "ANTENNA-INTEGRATED BATTERY ASSEMBLY"; which claims benefit of priority with U.S. Provisional Ser. No. 61/243,929; filed Sep. 18, 2009; titled "ANTENNA-INTEGRATED BATTERY ASSEMBLY"; and A continuation in part (CIP) of commonly owned U.S. Ser. No. 13/726,477, filed Dec. 24, 2012, titled "ANTENNA AND METHOD FOR STEERING ANTENNA BEAM DIRECTION"; which is a continuation of U.S. Ser. No. 13/029,564, filed Feb. 17, 2011, titled "ANTENNA AND METHOD FOR STEERING ANTENNA BEAM DIRECTION"; which is a continuation of U.S. Ser. No. 12/043,090, filed Mar. 5, 2008, titled "ANTENNA AND METHOD FOR STEERING ANTENNA BEAM DIRECTION".

FIELD OF THE INVENTION

The present invention relates to antennas for use in portable electronic devices, and more particularly to an antenna integrated on or within a battery assembly.

BACKGROUND OF THE INVENTION

A multitude of portable devices including cellular phones, personal media devices, and laptops are widely used and commercially available. These devices continue to become more popular as demand for improved devices continues to grow. As market trends move towards smaller devices in an effort to enhance portability, device components are collaterally constrained to meet market requirements. At the same time, consumers are demanding a multitude of applications for use with portable consumer electronics, such as internet, radio, television, communications, and others. As trends in consumer demands move towards multi-application portable electronic devices, component manufacturers are required to meet new requirements, and therefore develop novel solutions to satisfy consumer demands.

Because portability is an ongoing necessity in the portable electronics market, size constraints must remain a primary focus of component manufactures. Cell phones, for example, are becoming smaller in size and lighter in weight while providing an increased number of useable features, such as internet, radio, television (DVB-H), communications, and others. To meet the demand for multi-application cell phones, additional and/or larger antennas and other components have been required. Cell phone and other portable electronic device manufacturers are moving towards reducing size of components and unnecessary bulk space, and reusing space.

Antennas, specifically, have been a major focus of reducing size and space in electronic portable devices. Recently, FM radio and DVB-H TV reception have become requirements in a large number of mobile phones. Antenna performance is a key parameter for good reception quality. Mobile handsets are very small compared to wavelengths at FM and DVB-H frequencies; subsequently the antennas used for these applications on handsets will be electrically small. These electrically small antennas will be narrow band and require low loss matching techniques to preserve efficiency. Multiple electrically small antennas embedded in a small wireless device will tend to couple, thereby degrading performance. The reduced volume allowed for an internal antenna coupled with the strict requirement that the internal FM and DVB-H antennas must not interfere with the main antenna or other ancillary antennas in the handset makes the task of antenna matching across the wide range of frequencies quite difficult.

Current market-available antenna designs and prior art antennas are not suitable for overcoming the aforementioned problems. Taking into consideration the requirements for the next generation of devices along with the deficits of current technologies, a solution is needed which achieves efficiency from an internal antenna required to cover the large FM frequency band. Antennas commonly known and available which generally cover the whole frequency range tend to display inadequate antenna radiation efficiency at a fixed volume.

There is an immediate need for an improved antenna which will provide efficient operation over FM and DVB-H frequencies while providing a component volume capable of integration within strict and often very small design requirements of modern portable devices. There is a need for such an antenna that will further not interfere with other antennas or wireless components in the portable device. Furthermore, there is a need to optimize the space used in portable electronic devices by providing integrated device components for use within a shared space. There is also a need for an antenna which utilizes loading effects of a battery to enhance antenna operating characteristics, and a need for an antenna having active components near a power source.

SUMMARY OF THE INVENTION

Accordingly, it is an object of the present invention to solve these and other problems in the art by providing an improved antenna for enhanced performance of a related device by operating at FM and DVB-H frequencies without adding bulk space to the associated device. It is another objective to provide an antenna which utilizes various characteristics of a battery assembly for loading effects of the antenna, thereby improving antenna characteristics and performance. It is yet another objective to provide an active tunable antenna integrated into a battery assembly for reduced space and improved antenna matching. It is another goal of the various embodiments of the present invention to provide an enhanced antenna system which successfully enables efficient operation over FM and DVB-H frequencies while providing a component volume capable of integration within the strict design requirements of modern portable wireless devices. The antenna system must further operate without interference with the main antenna or other wireless components of the portable wireless device.

In keeping with these objectives and with others which will become apparent hereinafter, an antenna is provided, wherein the antenna is co-located on or within a battery assembly. The antenna may further include one or more active components for actively tuning the antenna. The one or more active components may further be located within the battery.

In a general embodiment, an assembly includes an anode, a cathode, and a separator therebetween. The anode, cathode and separator are enclosed within a battery housing. The battery housing provides a positive contact and a negative contact, otherwise herein referred to as battery terminals, for supplying power to a portable electronic device. The assembly further includes at least one antenna element positioned on or within the battery assembly.

The assembly may further include a circuit board to provide functions for monitoring the battery. The circuit board can further include one or more passive or active components to impedance match and dynamically tune an antenna.

The antenna element can be a planar conductor, a wire or a coil. The antenna element can also be etched within the battery housing, for example, a slotted battery housing. An additional metalized outer layer for substantially covering the battery assembly can be provided, wherein the metalized outer layer includes a slot antenna designed into the metal surface. The antenna element can also be printed or electroplated on the battery housing.

The antenna element can be positioned on the outer cover of the battery assembly. Alternatively, the antenna element can be integrated within the battery assembly. A polymer layer can be coated on the battery assembly and the antenna element positioned above the polymer layer, thereby isolating the antenna from the battery.

The battery assembly can include battery terminals, and one or more additional terminals. For example, the battery assembly can include a positive contact terminal and negative contact terminal for supplying power to the portable electronic device, a feed contact terminal for driving the antenna, and a ground contact terminal for connecting the antenna to ground.

In another embodiment, an active tunable antenna having an antenna element and an active tuning circuit is integrated into a battery assembly. The antenna element is attached to the outer surface of the battery assembly, or alternatively the antenna element may be co-located inside the battery assembly. The active tuning circuit is integrated into the battery. Power for the active tuning circuit is provided directly from the battery.

In another embodiment, the battery assembly includes multiple layers on the outer cover of the battery assembly. Each layer can include one or more portions of an antenna, thereby providing a multi-layer antenna assembly. For example, an antenna element can be attached to the outer layer while feed lines and distributed matching elements, such as transmission line elements, can be attached to inner layers. The multiple conductive layers used to form the antenna element and feed lines can be separated by non-conductive layers. The non-conductive layers can be formed from polymer, fiber, paper, or ferrite materials.

In another embodiment, one or more parasitic elements can be incorporated into the battery. Parasitic elements can be used for Hearing Aid Compatibility (HAC) reduction. Parasitic elements can also be used for Specific Absorption Rate (SAR) reduction.

In certain embodiments, at least one antenna being integrated into the battery is a modal antenna.

In preferred embodiments, the at least one modal antenna is an isolated magnetic dipole (IMD) modal antenna.

Other aspects and features of the present invention will become apparent to those having ordinary skill in the art upon review of the following description of specific embodiments of the invention in conjunction with the accompanying figures. It is to be understood that both the foregoing general description and the following detailed description are exemplary and explanatory only and are not restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

FIG. 9 further illustrates an ABS plastic insulating layer positioned on the battery assembly.

DETAILED DESCRIPTION OF THE PREFERRED EMBODIMENTS

Figure 1:
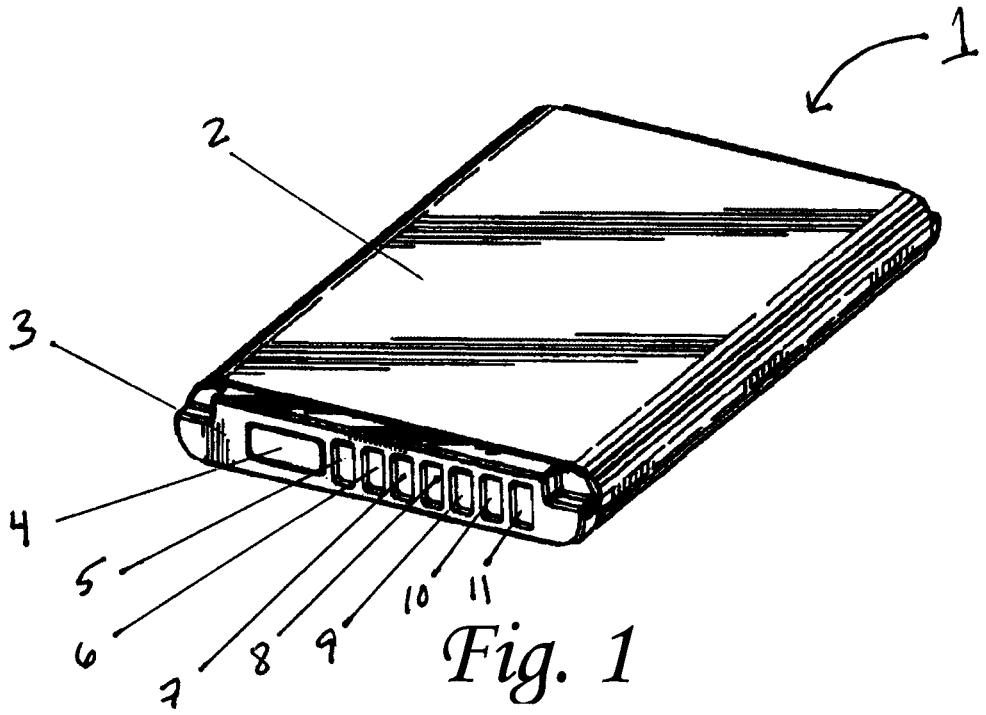
FIG. 1 is a perspective view of a battery assembly having seven contact terminals including a positive power terminal, negative power terminal, battery temperature terminal, battery identification terminal; antenna feed terminal, RF ground terminal, and a switch terminal.

A battery assembly, for use in portable electronic devices such as cell phones, laptops, media players and the like, includes an antenna element for incorporation on the surface or within the housing of the battery assembly. The battery assembly generally includes a plurality of contact terminals for electrically connecting the battery assembly, and antenna element to a portable electronic device.

Although a battery-integrated antenna can be designed to operate at any frequency, additional benefits are presented for low frequency antenna applications. Below 700 MHz, antennas integrated into wireless devices tend to become less efficient and more difficult to impedance match over small to moderate bandwidths due to the increase in wavelength and the typical small form factor of commercial wireless devices. The battery provides a useful platform for integrating a low frequency antenna because of the dielectric and magnetic loading effects that can be derived from the battery. By loading an antenna element in this regard, the low frequency antenna becomes physically reduced and can resonate at low frequencies.

In one aspect of the present invention, a multi-frequency, noise optimized active antenna consisting of one or several actively tuned antennas optimized over incremental bandwidths and capable of tuning over a large total bandwidth is integrated with a battery assembly for use with a portable electronic device. One or multiple impedance transformers are connected to the antennas at an optimal location, with the transformers acting to reduce the impedance for optimal coupling to a transceiver/receiver. The impedance transformer can be a MOSFET or any other type of semiconductor capable of transforming a higher impedance to a lower impedance with small signal voltage losses. Active components can be incorporated into the antenna structures to provide yet additional extension of the bandwidth along with increased optimization of antenna performance over the frequency range of the antenna. The radiating elements can be co-located with a ferrite material and/or active components coupled to the element to tune across a wide frequency range.

A circuit board can be integrated within the battery assembly, and several useful circuits can be used therewith. For example, the circuit board can contain a circuit to provide a means for detecting the temperature of the battery and disconnecting the battery load should the temperature exceed a recommended limit; i.e. overheat. Additionally, the circuit board can contain a circuit that has one or more passive or active components for impedance matching and dynamically tuning the antenna. Antenna feed and ground connections can be designed into the battery and can be located next to the battery terminals for efficient manufacturing of the antenna-battery assembly.

For purposes of this invention, a Passive component is defined as any element of an electric circuit that does not require power to operate.

For purposes of this invention, an active element is defined as any element that requires power to operate. These active components can provide an additional inductance or capacitance directly in series or shunt with an elongated portion of the antenna element, so as to modify the standing wave pattern existing along the elongated portion, or to change the effective electrical length of the elongated portion of the antenna element. The active component provides a reactance that cancels the reactance of the antenna, allowing for optimal radiation. Examples of active elements include: a varactor diode, tunable capacitor, or switched capacitor network.

For purposes of this invention, a tuning circuit includes one or more passive or active components connected to the antenna for providing a matched impedance.

An antenna element is integrated with the battery assembly. The antenna element can be one of a coil, monopole, dipole, inverted F antenna, microstrip antenna, single resonance Isolated Magnetic Dipole (IMD) antenna, dual resonance IMD antenna, planar IMD antenna, or a wire. Multiple antenna elements can be integrated with the battery assembly.

The antenna element can be configured on the external portion of the battery housing. An insulating layer fabricated from a polymer, fiber, paper, or a ferrite material can be coated on the exterior portion of the battery assembly, and the antenna element can be configured above the insulating layer.

The antenna element can be configured on the battery housing. For example, a metalized battery housing can comprise one or more slots, the battery housing having slots can be configured as an antenna element.

The antenna element may also be incorporated within the battery assembly. For example, a coil element can be enclosed within the battery housing. The coil element can be connected to an active circuit, the active circuit formed on a circuit board within the battery assembly.

The battery assembly can comprise a contact terminal for connecting an additional length of conductor. The additional length of conductor can be connected via a switch, such that multiple resonant frequencies can be utilized by the antenna. The switch can be connected to an active tuning circuit, for actively switching the antenna.

One substantial benefit of integrating an antenna into a battery housing includes minimizing the volume required by the device. A particular benefit of locating the antennas of the present invention with a battery assembly includes strategic location and availability of power for the antenna and active components. Another particular benefit for locating certain antennas of the present invention within a battery assembly includes strategically utilizing available dielectric and magnetic loading provided by the battery. An antenna positioned near a battery is herein said to comprise a battery load component, as the antenna is configured to operate in the presence of the dielectric and magnetic loading of the battery. An antenna can be further tuned using one or more active elements.

Additional contact terminals can be provided on the battery assembly for simplifying connections with the device and certain features. For example, a contact terminal can be positioned on the battery assembly for providing a connection of the antenna to a transceiver in the wireless device when the battery and integrated antenna assembly is installed in the device.

The external portion of the battery assembly can comprise multiple layers, such that a multi-layer antenna assembly can be integrated into the battery. For example, the antenna element can be configured on the outer layer, feed lines and distributed matching elements such as transmission line element can be configured on inner layers. The multiple conductive layers used to form the antenna element and feed lines can be separated by non-conductive layers. The non-conductive layers can be fabricated by a polymer, fiber, paper, ferrite material, or any combination thereof.

One or more parasitic elements can be incorporated into the battery. Parasitic elements can be used to optimize the battery for Hearing Aid Compatibility (HAC) reduction, and Specific Absorption Rate (SAR) reduction.

In another embodiment of the invention, switches or other active components are coupled to the antenna element to provide additional optimization in frequency response. The tuned loop coupled to the antenna with active components is adjusted to provide optimization of the impedance match of the antenna along with optimization of the radiating structure.

Recently, antennas have been developed which are capable of beam steering and frequency tuning using a single antenna radiating element such as for example the multi-mode, or "modal antennas", as described in commonly owned U.S. Pat. No. 7,911,402, issued Mar. 22, 2011, and titled "ANTENNA AND METHOD FOR STEERING ANTENNA BEAM DIRECTION"; the contents of which are hereby incorporated by reference. Thus, in an embodiment the invention comprises a battery assembly with an integrated modal antenna. The modal antenna generally comprises an antenna radiating element positioned above a ground plane forming an antenna volume therebetween. A first parasitic element is coupled to a first active component, the first parasitic element being positioned outside of the antenna volume and adjacent to the antenna radiating element such that the first parasitic element is positioned close enough to the antenna radiating element to induce a shift in the radiation pattern but also remaining outside of the antenna volume such that the first parasitic element is not positioned within fringing fields that extend between the antenna radiating element to the ground plane. A second parasitic element is coupled with a second active component and positioned between the antenna radiating element and the ground plane, or within the antenna volume, such that the second parasitic element is configured to capacitively couple with the antenna radiating element for causing a shift in the frequency response of the antenna. Thus, the antenna radiating element, first parasitic element, and second parasitic element form the modal antenna capable of rotating or steering the antenna radiation pattern and shifting the frequency response of the antenna.

In this embodiment, the battery assembly can include multiple substrate layers such that a first layer may comprise a ground plane for the antenna, a second layer disposed above the first layer may comprise one or more parasitic elements, and a third substrate layer may comprise the antenna radiating element, such that the three layers form an active modal antenna as described above. Thus, the battery comprises at least one active modal antenna.

Depending on the requirements of the antenna, it may be preferred to provide an isolated magnetic dipole (IMD) antenna element as the antenna radiating element of the modal antenna. The isolated magnetic dipole element generally comprises a conductor having an inductive loop forming a magnetic dipole moment, and a capacitive overlapping region for creating an internal reactance which enhances the antenna isolation and performance.

Turning now to the FIG. 1, a battery assembly 1 is provided having a plurality of contact terminals 5-11 positioned on an outer surface of the battery housing, specifically on a contact terminal plate 3. Contact terminals can be provided to integrate a number of components with a portable electronic device. Although any number of contact terminals can be provided, FIG. 1 illustrates seven contact terminals. Contact terminals connect the portable electronic device to the positive 5 and negative 11 battery power terminals, a temperature sensor terminal 6, battery identification terminal 7; antenna feed terminal 8, RF out terminal 9, and a switch terminal 10. The external surface of the battery housing 2 can be coated with a polymer or other non-conductive material to insulate the battery. A supplemental contact terminal 4 is positioned on the exterior surface of the battery. The supplemental contact terminal 4 can be used to connect a component to the portable electronic device.

Figure 2:
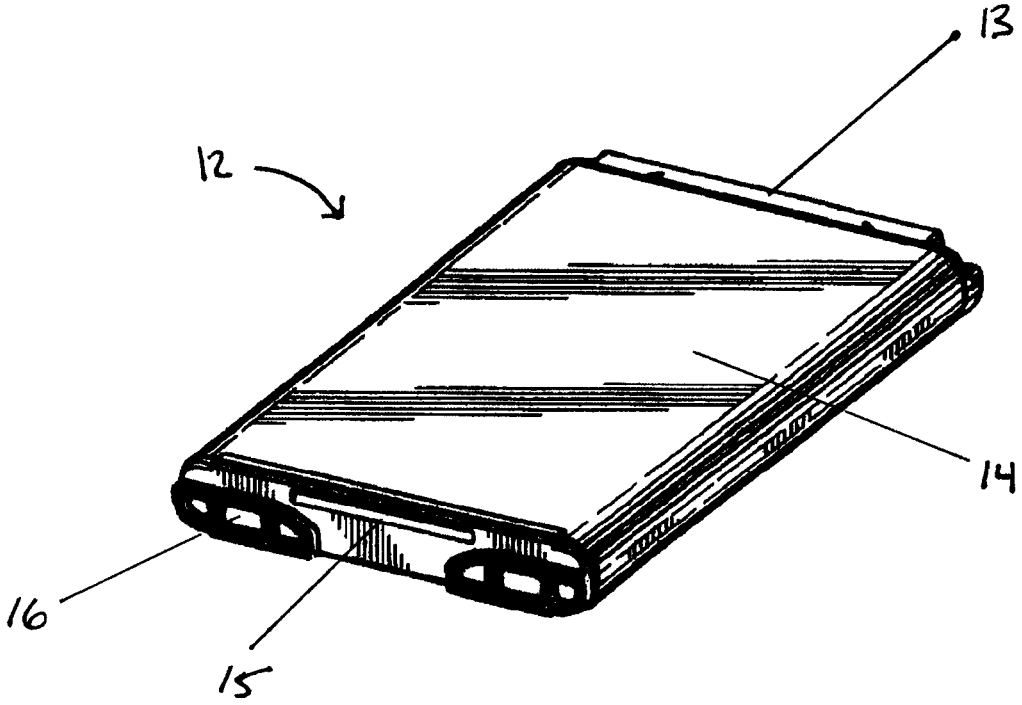
FIG. 2 is a perspective view illustrating the opposite sides of the battery of FIG. 1, the battery assembly including an external battery housing and a number of fitting shims.
Figure 3A:
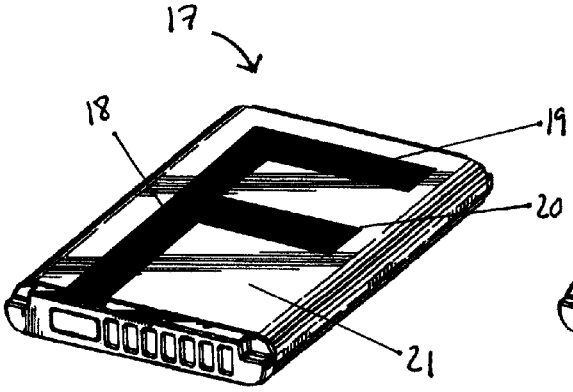
FIGS. 3(A-D) are perspective views of the battery of FIG. 1 having an external antenna element attached to the outer surface of the battery assembly. Various embodiments of an external antenna element are illustrated.
Figure 3B:
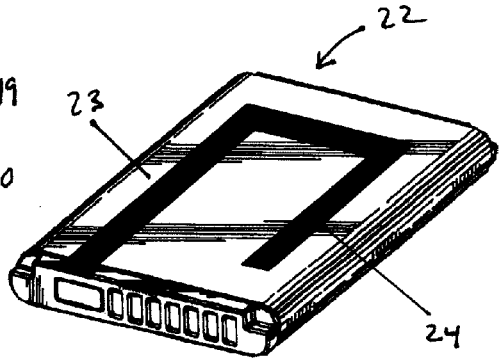
Figure 3C:
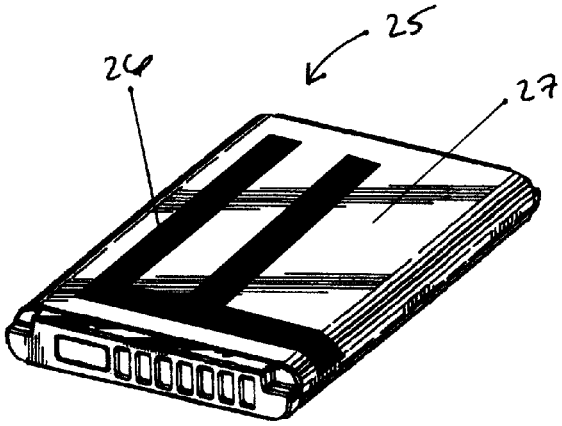
Figure 3D:
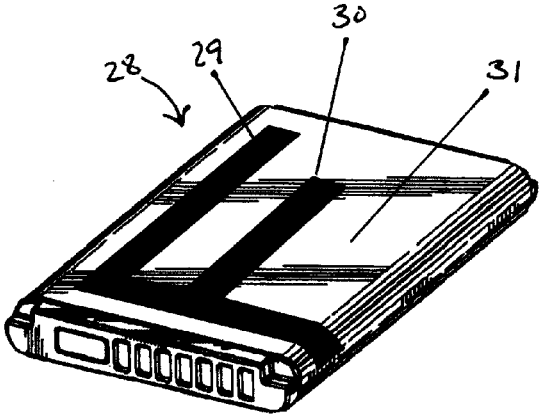

FIG. 2 illustrates the opposite sides of the battery assembly 12 of FIG. 1. The battery assembly includes a cathode, an anode, a separator therebetween, and a battery housing 14 enclosing the battery components. A contact terminal plate 13 is positioned on an outer surface of the battery. Fitting shims 16 can be positioned on the external surface of the battery assembly for providing a means to fixedly position the battery within a portable electronic device. A tab 15 can be used to further secure the battery to the portable electronic device. The tab 15 an be a conductor for electrically connecting a component of the battery assembly with the portable electronic device.

FIGS. 3(*a-d*) illustrate several embodiments of the battery assembly 17; 22; 25; 28 of FIG. 1. The battery enclosure includes an antenna element 18; 24; 26 positioned on the external surface of the battery assembly. The antenna element can have fingers 19, 20; 29, 30 having various lengths for radiating at desired frequencies. The battery assembly 17; 22; 25; 28 further comprises an insulating layer 21, 23, 27, 31 on the external surface of the battery housing. The layer can be a polymer, fiber, paper, or ferrite material, or any combination thereof. The antenna element 18; 24; 26; 30 is positioned above the insulating layer of the battery housing.

Figure 4:
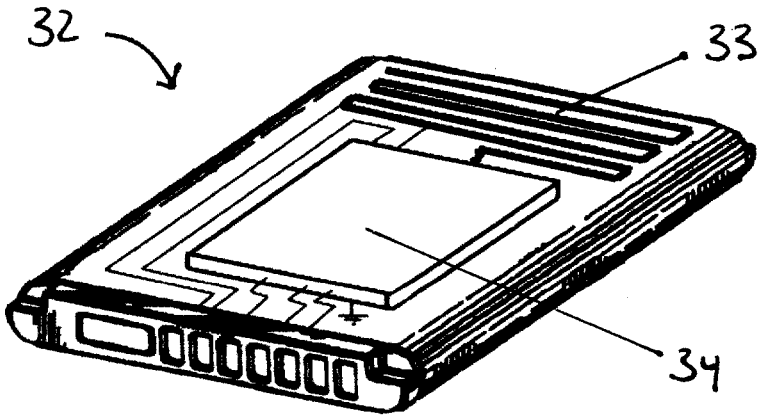
FIG. 4 is a perspective view illustrating the battery assembly of FIG. 1 having a circuit board positioned within the battery housing; the circuit board provides a means for monitoring the battery temperature, disabling the battery upon overheating, and active tuning circuitry for actively configuring an attached antenna element.

FIG. 4 illustrates the battery assembly 32 having a circuit board 34 enclosed within the battery housing. The circuit board comprises one or more of: a battery disconnect circuit, an antenna impedance matching circuit, and a switch. The circuit board is electrically connected to an antenna element 33. The antenna element 33 is positioned within the battery housing. The portable electronic device components are connected to the battery assembly components at one or more of the contact terminals positioned on the exterior surface of the battery. The circuit board is also connected to ground via a contact terminal on the external surface of the battery assembly.

An antenna element can be configured within the battery assembly. FIG. 4 further illustrates a coil antenna element 33 electrically connected to a circuit board 34 within the battery housing. In this embodiment, it would be advantageous to provide an active tuning circuit on the circuit board for actively tuning the antenna.

Figure 5:
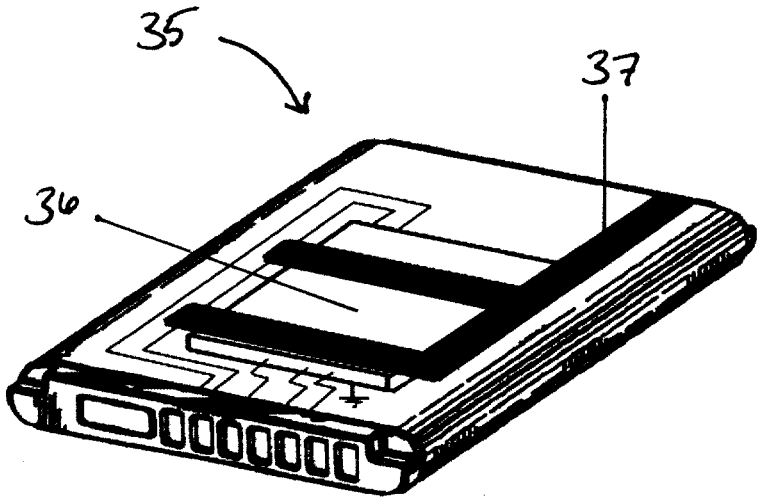
FIG. 5 illustrates a perspective view of the battery assembly of FIG. 4, the battery assembly further including a surface mounted antenna element.

FIG. 5 illustrates a variation of the battery assembly of FIG. 4, where the antenna element 37 is positioned on the exterior surface of the battery assembly 35. In this embodiment, the antenna element 37 is connected to a circuit board 36; the circuit board 36 is positioned within the battery housing. The circuit board 36 can comprise a circuit for active tuning the antenna.

Figure 6:
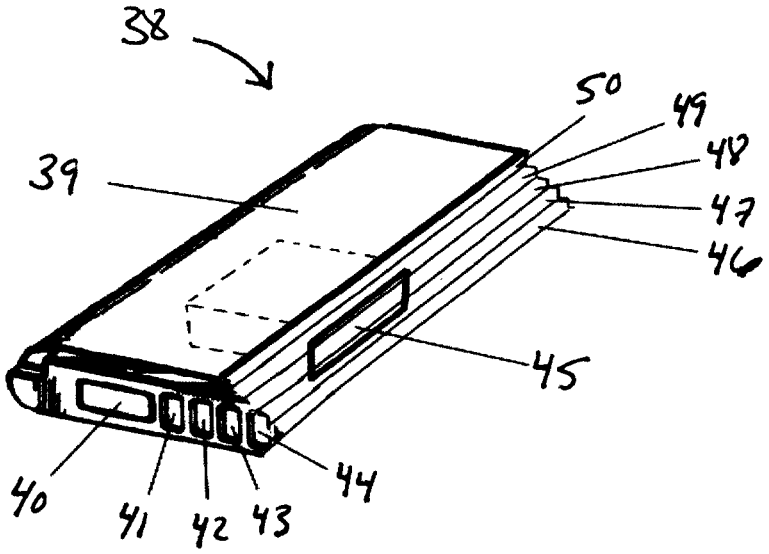
FIG. 6 is a cross-section view illustrating the internal configuration of a battery in one embodiment of the invention, the battery including an anode and a cathode separated by a separator, a circuit board is positioned within the battery assembly, and a battery housing encloses and hermetically seals the internal components within the battery assembly.

FIG. 6 illustrates a cross-sectional view of the battery assembly 38. The internal portion of the battery includes an anode 47, a cathode 49, and a separator 48 positioned therebetween. A battery housing 39 encloses the inner portions of the battery. A circuit board 45 is positioned within the battery enclosure 39. The circuit board may include an antenna impedance matching circuit, a battery disconnect circuit, or a switch. The exterior portion of the battery assembly includes a number of contact terminals 40-44 for connecting battery assembly components with portable electronic device components.

Figure 7:
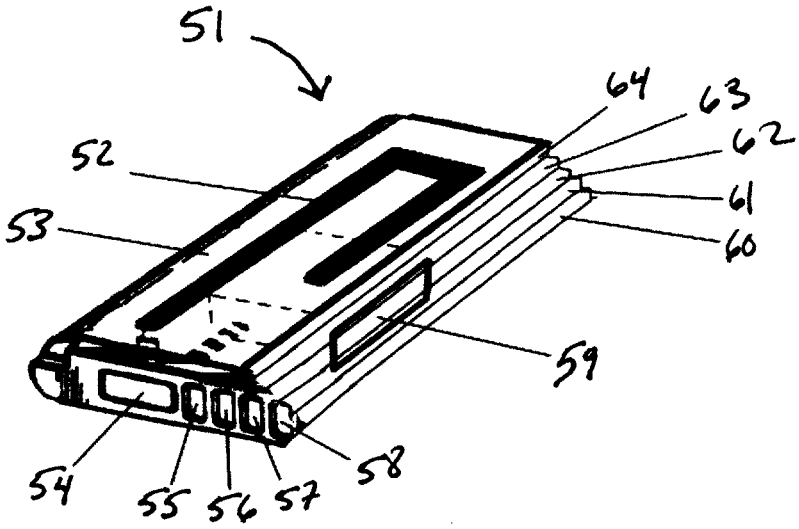
FIG. 7 is a cross-section view illustrating the battery assembly of FIG. 6, the battery assembly further including an external mounted antenna element, the antenna element is connected to the circuit board where an active circuit provides a means to actively tune the antenna.

FIG. 7 illustrates the battery assembly of FIG. 6. The battery assembly 51 further including an antenna element 52 positioned on the external surface 53 of the battery assembly. A single resonance Isolated Magnetic Dipole (IMD) element 52 is illustrated in FIG. 7. The IMD element 52 is connected to a circuit board 59. The circuit board 59 can comprise an active tuning circuit for actively tuning the antenna. The inner portion of the battery assembly includes an anode 61, cathode 63 and a separator 62 positioned therebetween. A battery housing 60,64 encloses the inner portions of the battery assembly. The external surface of the battery assembly includes a plurality of contact terminals 54-58.

Figure 8:
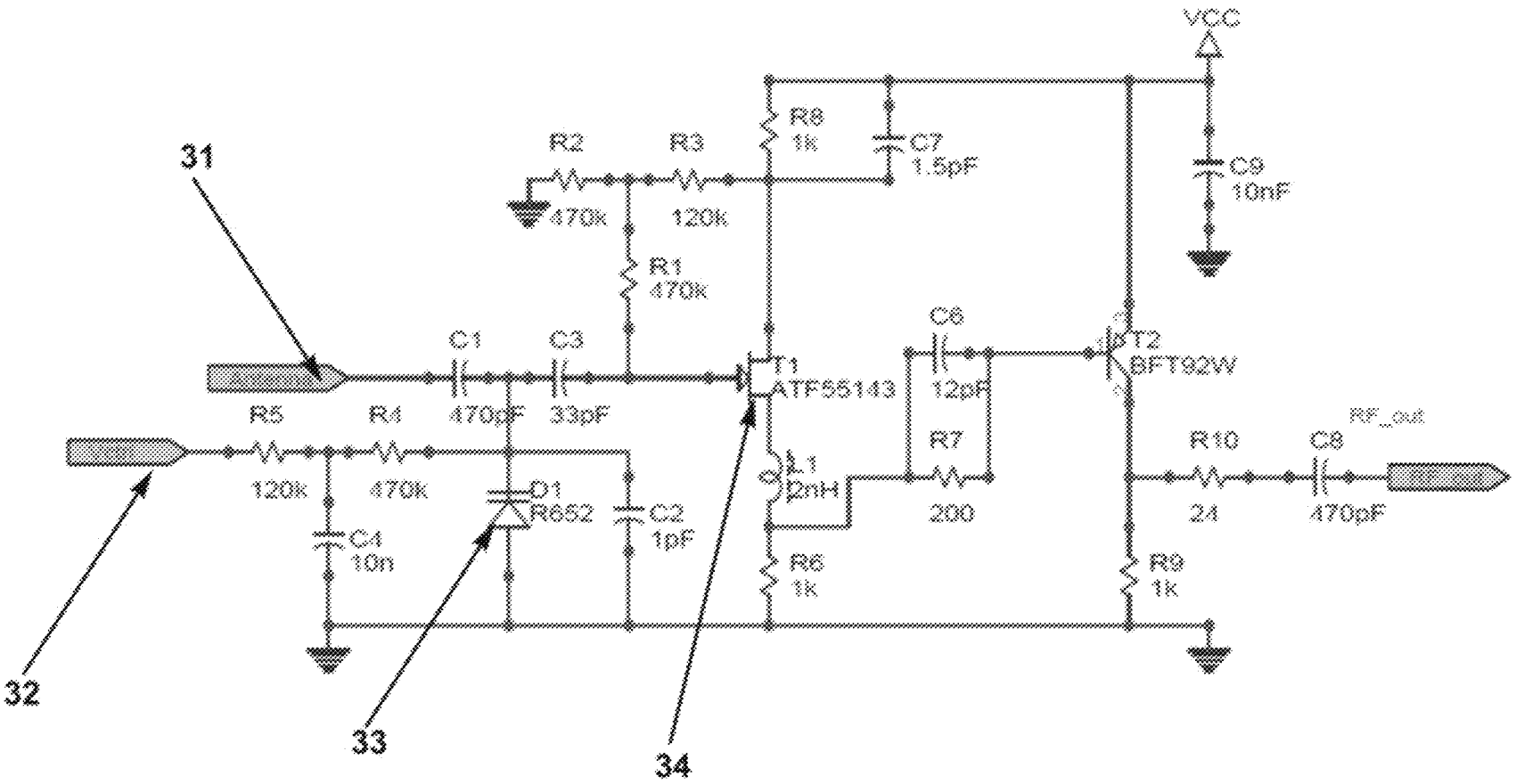
FIG. 8 is a schematic illustrating one embodiment of the antenna circuit including an antenna element connected to an active tuning circuit.

FIG. 8 is a schematic illustration of the antenna circuitry for integration with the battery assembly. The schematic 65 includes an antenna element 66 connected to an impedance matching circuit. The Vctrl 67 is positioned on a contact terminal located on the outer surface of the battery assembly. The RFOut is also positioned on a contact terminal located on the outer surface of the battery assembly. The antenna element 66 is tuned using a control voltage 67, and an active tuning element such as a varactor diode 68 is used to vary the resonant frequency of the antenna element within a range as defined by the reactive elements of the antenna. A MOSFET impedance transformer circuit component 69 is used to match the tuned antenna loops to the receiver circuitry.

Variations of the matching circuitry illustrated in FIG. 8 can be designed by one having ordinary skill in the art. One principle feature of the invention includes a circuit board positioned on or within a battery assembly for providing an antenna matching circuit.

Figure 9:
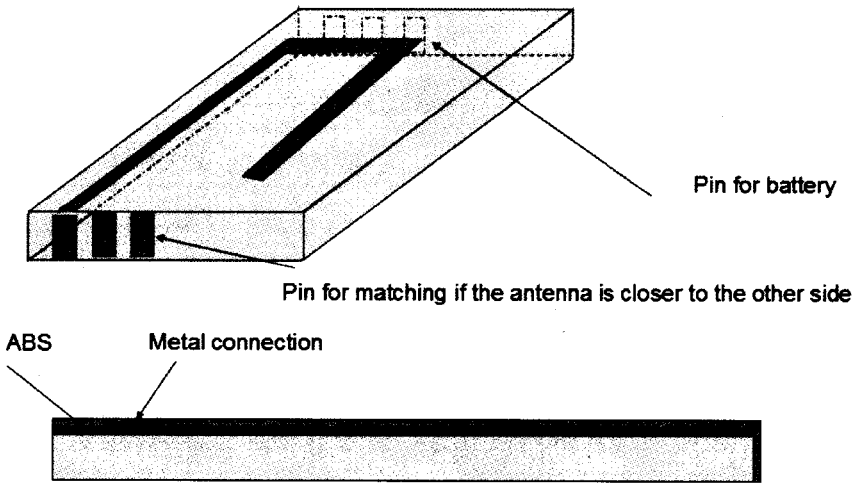
FIG. 9 is a perspective view of the battery assembly in an embodiment of the invention where contact portions are positioned on multiple sides of the battery assembly.

FIG. 9 illustrates an embodiment of the invention where a first number of contact terminals are positioned on a first end of the battery assembly, and a second number of contact terminals are positioned on a second end of the battery assembly. FIG. 9 further illustrates a coating applied to the external surface of the battery assembly. Here, the external coating is ABS plastic. A metal connector can then be positioned above the ABS layer on the outer surface of the battery assembly.

Figure 10:
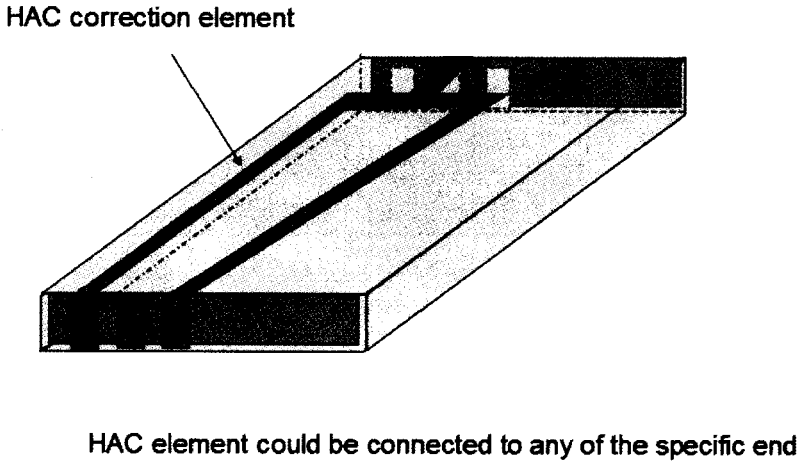
FIG. 10 is a perspective view of the battery assembly including a parasitic element for Hearing Aid Compatibility correction.

FIG. 10 illustrates a Hearing Aid Compatibility (HAC) element positioned on the external surface of the battery assembly. The HAC element is a parasitic element for coupling to the electrical circuitry of the portable electronic device. In another embodiment, one or multiple parasitic elements can be positioned on or within the battery assembly for reduction of Specific Absorption Rate (SAR).

Figure 11:
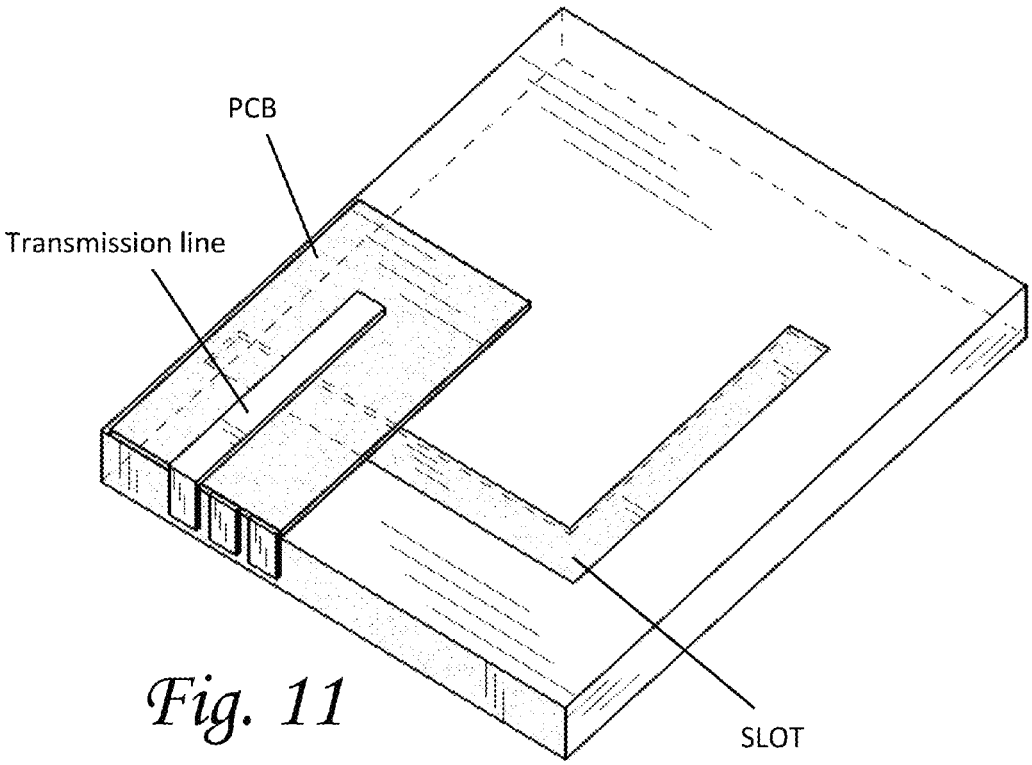
FIG. 11 is a perspective view of the antenna-integrated battery assembly of the invention, the battery assembly including a slotted antenna.

FIG. 11 illustrates a slotted antenna etched into a planar metal portion. The planar metal portion can be the battery housing itself, or an additional planar metal portion for attachment to the external surface of the battery assembly. One or more slots are etched into the planar metal portion, defining a slotted antenna. One or more slots can be etched to fabricate virtually any type of planar antenna element. A polymer material can be used to fill the slots, such that the battery assembly remains hermetically sealed. In the battery assembly illustrated in FIG. 11, the antenna is connected to a PCB with a strip line on the back of the battery. A transmission line is used to excite the slot.

Figure 12:
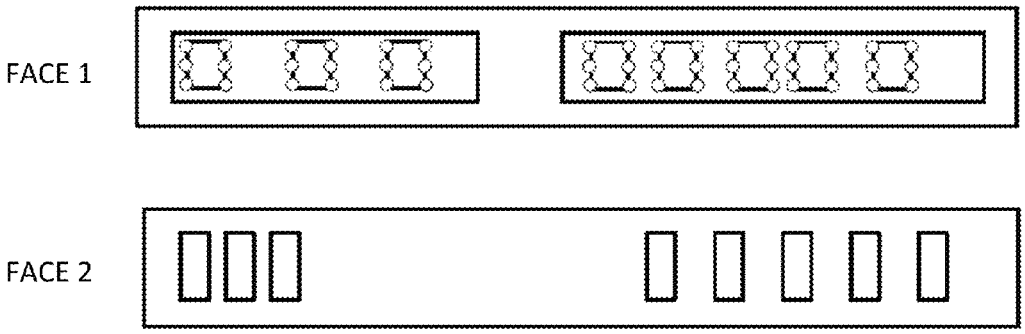
FIG. 12 illustrates a side view of the battery assembly having contact terminals configured in various embodiments.

FIG. 12 illustrates an embodiment including additional contacts designed into the battery to feed, ground, switch, or connect the antenna to subsystems in the wireless device.

The present invention is defined by the claims appended hereto, with the forgoing description being merely illustrative of a preferred embodiment of the invention. Those of ordinary skill in the art may envisage certain modifications to foe forgoing embodiments which, although not explicitly discussed herein, do not depart from the scope of the invention, as defined by the appended claims.

What is claimed is:

1. A modal-antenna integrated battery assembly, comprising:

a battery assembly having an inner portion enclosed within a battery housing, said inner portion including an anode, cathode, and a separator positioned therebetween; and a modal antenna integrated within said battery assembly, said modal antenna comprising:

a first antenna element positioned above a ground plane and forming an antenna volume therebetween;

a first parasitic element positioned outside of said antenna volume and adjacent to said first antenna;

a first active tuning element associated with said first parasitic element, said first active tuning element adapted to vary a current mode about said first parasitic element for actively steering a radiation pattern associated with said first antenna element;

a second parasitic element positioned within said antenna volume; and a second active tuning element associated with said second parasitic element; said second active tuning element adapted to vary a reactive coupling between said first antenna element and said second parasitic element for actively tuning a frequency characteristic associated with said first antenna element;

wherein each of the first and second parasitic elements are configured to be adjusted using the corresponding first and second tuning elements for actively changing a radiation pattern characteristic associated with the antenna.

2. The assembly of claim 1, wherein said first antenna element is one of: a coil, monopole, dipole, inverted F antenna (IFA), microstrip antenna, single resonance Isolated Magnetic Dipole (IMD) antenna, dual resonance IMD antenna, planar IMD antenna, or a wire.

3. The assembly of claim 2, wherein said first antenna element is positioned on an exterior surface of the battery assembly.

4. The assembly of claim 2, wherein said first antenna element is positioned within the battery assembly.

5. The assembly of claim 2, wherein one or more slots are etched into the battery housing forming a second antenna.

6. The assembly of claim 2, further comprising a circuit board disposed within the battery assembly.

7. The assembly of claim 6, wherein the circuit board is electrically connected to the first antenna element.

8. The assembly of claim 6, wherein the circuit board comprises one or more passive or active elements for statically or dynamically tuning the antenna.

9. The assembly of claim 1, wherein said first antenna element is formed with multiple substrate layers.

10. The assembly of claim 1, wherein said first antenna element comprises a battery load component.

11. The assembly of claim 1, further comprising a coating, said coating comprising a polymer, fiber, paper, or ferrite material.

12. The assembly of claim 1, further comprising a second antenna.

13. The assembly of claim 12, wherein said second antenna is operate at one or more of: FM and DVB-H frequencies.

14. The assembly of claim 1, further comprising a third parasitic conductor, wherein said third parasitic conductor is configured to adjust at least one of: Hearing Aid Compatibility (HAC) or Specific Absorption Rate (SAR).

* * * * *